United States Patent [19]

Shannon

[11] 4,201,247

[45] May 6, 1980

[54] FIBROUS PRODUCT AND METHOD AND APPARATUS FOR PRODUCING SAME

[75] Inventor: Richard F. Shannon, Lancaster, Ohio

[73] Assignee: Owens-Corning Fiberglas Corporation, Toledo, Ohio

[21] Appl. No.: 811,234

[22] Filed: Jun. 29, 1977

[51] Int. Cl.[2] ..... D04H 1/58; B32B 5/06; B32B 5/22; B32B 17/00

[52] U.S. Cl. ..... 138/141; 65/4 R; 138/140; 138/DIG. 2; 156/62.2; 156/62.8; 428/36; 428/297; 428/302; 428/288; 428/317; 264/113

[58] Field of Search ..... 156/62.2, 62.4, 62.6, 156/62.8; 428/36, 280, 282, 284, 285, 288, 297, 298, 302, 317, 426, 428; 65/4 R; 138/DIG. 2, 124, 137, 140, 141; 264/113

[56] References Cited

U.S. PATENT DOCUMENTS

| | | | |
|---|---|---|---|
| 2,877,124 | 3/1959 | Welsch | 106/50 |
| 2,882,173 | 4/1959 | Welsch | 106/50 |
| 2,897,874 | 8/1959 | Stalego et al. | 156/62.2 |
| 2,946,371 | 7/1960 | Stephens et al. | 156/62.4 |
| 3,002,224 | 10/1961 | Stalego et al. | 65/6 |
| 3,088,573 | 5/1963 | Tkacs | 198/479 |
| 3,220,915 | 11/1965 | Shannon | 428/920 |
| 3,328,230 | 6/1967 | Levecque et al. | 428/296 |
| 3,331,669 | 7/1967 | Sinclair | 65/4 R |
| 3,690,852 | 9/1972 | Smith et al. | 156/62.2 |
| 3,759,680 | 9/1973 | Kleist et al. | 65/6 |
| 3,922,425 | 11/1975 | Plumberg | 428/489 |
| 4,009,735 | 3/1977 | Pinsky | 428/36 |
| 4,044,188 | 8/1977 | Segal | 156/62.2 |
| 4,070,519 | 1/1978 | Lefkowitz et al. | 428/297 |

FOREIGN PATENT DOCUMENTS 2232785 5/1975 Fed. Rep. of Germany .

*Primary Examiner*—William J. Van Balen
*Attorney, Agent, or Firm*—Ronald C. Hudgens; Patrick P. Pacella; Harry O. Ernsberger

[57] ABSTRACT

The disclosure embraces a fibrous product comprising amorphous glass fibers and crystallizable mineral fibers wherein the mineral fibers may be formed of fusible rock, slag, basalt rock or fibers formed of blends or mixtures of these materials or crystallizable ceramic fibers and to a method and apparatus for forming or processing blends, composites or laminations of such fibers to produce several composite fibrous end products having various uses such as fire rated acoustical tile and ceiling board, high temperature block and pipe insulations, roofing insulation, form board, fire rated cores for walls and doors, fire rated hardboard and building, pouring and blowing wool insulation.

12 Claims, 13 Drawing Figures

FIBROUS PRODUCT AND METHOD AND APPARATUS FOR PRODUCING SAME

The invention relates to products fashioned of two or more kinds of fibers formed of different materials having different characteristics, and to a method of and apparatus for forming, combining, blending or laminating fibers of the different materials. The invention more especially relates to forming, combining, blending or laminating crystallizable mineral fibers and amorphous glass fibers, and to a method of processing such fibers and end products fashioned of the two kinds of fibers.

Crystallizable fibers are made by well known cupola processes or by electric melting furnaces from fusible rock or slag or combinations of fusible rock and slag and are usually referred to as mineral fibers. Ceramic fibers, such as aluminum silicate fibers, are also crystallizable, and such ceramic fibers, rock wool fibers and slag wool fibers are referred to herein as crystallizable mineral fibers. Crystallizable mineral fibers, such as rock wool and slag wool fibers, have been heretofore used as thermal insulation in the form of batts, mats or in nodules of a character which may be blown into spaces in building constructions.

Mineral wool fibers are usually comparatively short, and products such as hardboards or panels fashioned of compressed mineral fibers have comparatively low strength characteristics by reason of the short length fibers. Crystallizable mineral fibers have a further disadvantage in that they contain a high "shot" content, that is, particles of unfiberized mineral material. However, mineral wool fibers and particularly mineral fibers having a high iron content have good thermal properties as they are comparatively short and hence a mass of such fibers provides a tortuous path for heat transfer through the pack.

Crystallizable mineral fibers have a high resistance to fire or flame and further have the characteristic of crystallizing at temperatures above 1000° F., this characteristic being particularly desirable where the fibers are used for fire resistant insulation. For example, a ceiling tile or panel fashioned of mineral fibers, when subjected to high temperature such as that encountered by fire, is highly resistant to collapse as the mineral fibers crystallize or devitrify into a substantially rigid mass.

Glass fibers formed from amorphous glass have several advantages not found in products fashioned of crystallizable mineral fibers. Glass fibers are usually longer and hence impart high strength characteristics to products fashioned of such fibers. Masses of glass fibers have no appreciable "shot" content as the glass fiber-forming processes attenuate substantially all of the material of the glass streams into fibers.

Glass fibers, when pressed or formed into panels, tiles, hardboard or the like, provide smooth, attractive surfaces and hence surfaces of walls, ceilings and the like faced with glass fiber panels or tiles do not require finishing other than light sanding, painting or facing with a film. While amorphous glass fibers are resistant to temperatures below their fusing point, under high temperatures the glass fibers fuse or melt and wall panels or ceilings fashioned of glass fibers may collapse when subjected to high temperature flames.

The invention embraces a method of processing resin-bearing crystallizable mineral fibers and resin-bearing amorphous glass fibers with the resin in a particularly cured "B" stage which results in fibrous products having performance characteristics superior to those products produced from either crystallizable mineral fibers or amorphous glass fibers used alone.

The invention embraces composite fibrous products of various types resulting from combining, blending, laminating or processing crystallizable mineral fibers and amorphous glass fibers in a manner to produce such products.

An object of the invention resides in producing fibrous products of crystallizable mineral fibers and amorphous glass fibers which have improved thermal properties and high fire or heat resistance.

Another object of the invention resides in forming amorphous glass fibers and concomitantly mixing, blending or bringing together crystallizable mineral fibers and amorphous glass fibers to form a composite mass or mat of the fibers having improved fire resistance characteristics and improved insulating characteristics.

Another object of the invention resides in a method of forming amorphous glass fibers, delivering bonding resin onto the glass fibers, collecting the glass fibers in a mass, feeding mineral fibers bearing a bonding resin into contiguous relation with the glass fibers, and processing the composite mass of fibers into a body of desired density, and curing the resin in the body.

Another object of the invention resides in a method of concomitantly mixing or blending amorphous glass fibers and crystallizable mineral fibers, collecting the mixture or blend of fibers on a conveyor, the two types of fibers being substantially homogeneously distributed throughout the collected mass of fibers.

Another object of the invention resides in forming a body of attenuated amorphous glass fibers, delivering an uncured bonding resin onto the glass fibers, collecting the glass fibers in a layer on a conveyor, delivering crystallizable mineral fibers bearing an uncured resin into contiguous relation with the glass fibers whereby a composite fibrous mass is formed, compressing the collected crystallizable mineral fibers and amorphous glass fibers to a body of increased density, and curing the resin in the fibers to establish rigidity in the compressed body of fibers.

Another object of the invention resides in establishing a layer of crystallizable mineral fibers bearing a partially cured bonding resin, establishing a layer of amorphous fibers bearing a partially cured bonded resin in contiguous relation with the layer of crystallizable mineral fibers, compressing the fibrous body comprising the layers of fibers to an increased density, and curing the resin on the fibers to form a substantial rigid composite fibrous product.

Another object of the invention resides in processing amorphous glass fibers and crystallizable mineral fibers to establish a blend or mixture of the fibers having characteristics enhancing the use of the blended fibers for installation by an air blowing process.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

In order to clarify the terms identifying fibers embraced within the invention, there are two types of fibers referred to herein, viz. crystallizable mineral fibers and amorphous glass fibers. Crystallizable mineral fibers as used herein refer to fibers made from fusible rock, including basalt rock, slag or fibers made from mixtures of fusible rock and slag or ceramic materials such as aluminum silicate, the normal process of forming crystallizable mineral fibers including the use of a conventional cupola containing the fusible mineral materials fired with coke or the mineral material melted in an electric furnace.

The term amorphous glass fibers as used herein refers to amorphous glass compositions which do not readily crystallize and that may be attenuated into comparatively fine or coarse fibers, the glass compositions being of conventional character which are attenuable to fibers of comparatively long lengths depending upon the fiberizing process employed. The amorphous glass compositions may be of the character disclosed in U.S. Pat. to Welsch Nos. 2,877,124 and 2,882,173.

Figures 1, 2:
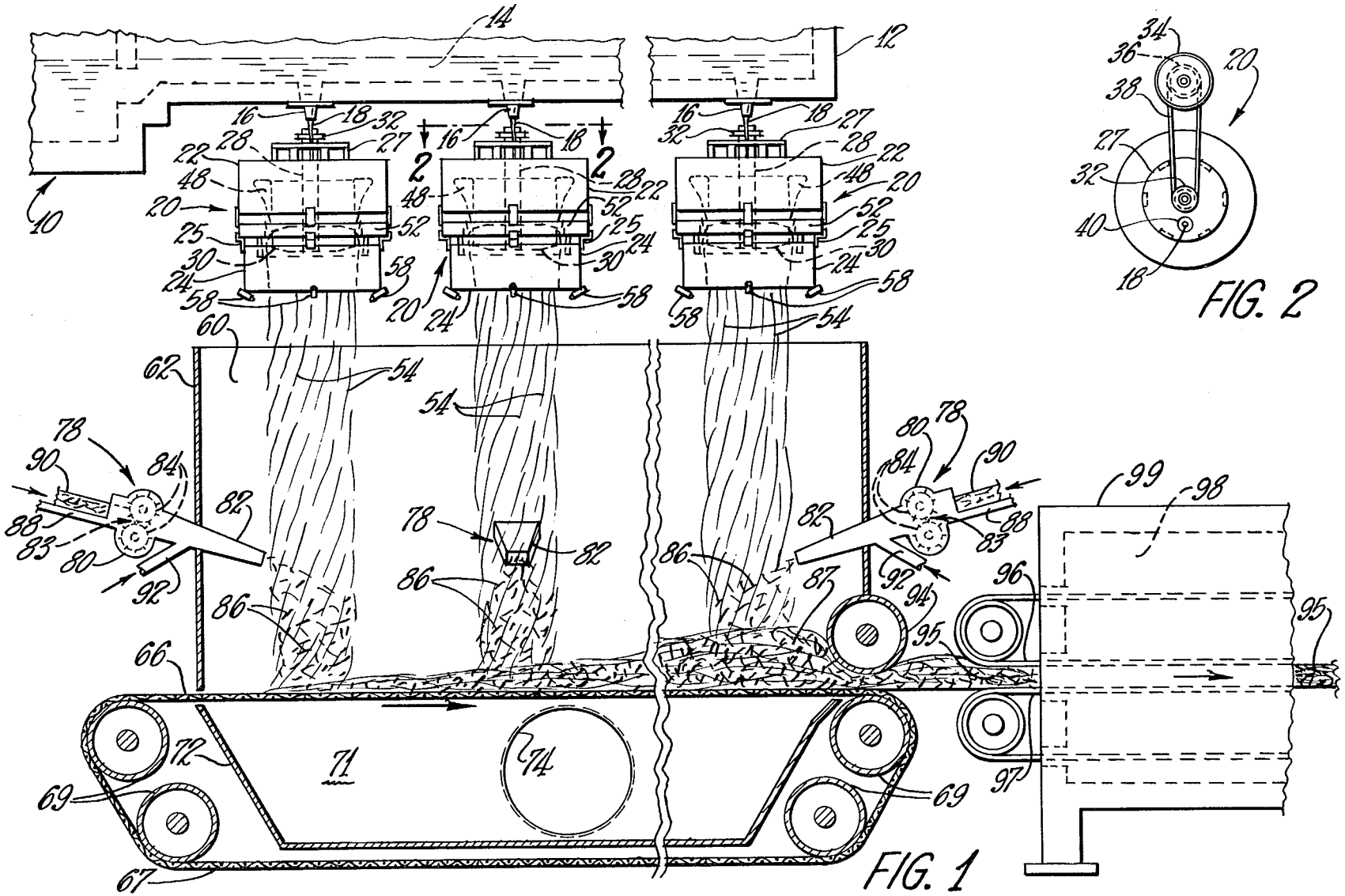
FIG. 1 illustrates a method and arrangement for mixing attenuated fibers of amorphous glass and crystallizable mineral fibers and further processing the fibrous mass.
FIG. 2 is a plan view of one of the amorphous glass fiber-forming units shown in FIG. 1, the view being taken substantially on the line 2—2 of FIG. 1.

Referring to the drawings in detail and initially to FIG. 1, there is illustrated an arrangement or apparatus for forming attenuated fibers of heat-softened amorphous glass and for mixing or commingling crystallizable mineral fibers with the attenuated amorphous glass fibers and processing the mass of commingled fibers. FIG. 1 illustrates a melting and refining furnace 10 in which amorphous glass batch is conditioned by the application of heat in a conventional manner to a heat-softened or flowable state, the flowable glass being refined in the furnace construction.

Connected with the furnace 10 is a forehearth 12 having a channel 14 in which glass flows from the furnace. Arranged along the bottom of the forehearth in spaced relation are stream feeders or bushings 16, each feeder flowing or delivering a stream 18 of amorphous glass from the forehearth channel 14. A fiber-forming unit or instrumentality 20 is disposed beneath each stream feeder and each unit adapted to receive a glass stream 18. The fiber-forming arrangement illustrated in FIGS. 1 and 2 is of the general character of that disclosed in Kleist U.S. Pat. No. 3,759,680.

FIG. 2 illustrates a top plan view of one of the units 20. While three fiber-forming units 20 are illustrated in FIG. 1, it is to be understood that a greater or lesser number of units may be employed depending upon the rate of production of attenuated amorphous glass fibers desired. Each fiber-forming unit 20 is adapted for forming the glass of a stream 18 into discrete bodies, primary filaments or small streams by centrifuging the heat-softened glass from a hollow spinner or rotor, the linear bodies, primary filaments or small streams being attenuated to fibers by an annularly-shaped, high velocity gaseous blast.

The fiber-forming units 20 include support members 22 which are mounted by conventional structural frame means (not shown). The fiber attenuating region of each fiber-forming unit is surrounded or embraced by a thin-walled cylindrically-shaped guard 24 supported by brackets 25. Journally supported in bearings mounted by a frame member 27 is a shaft 28, a hollow spinner or rotor 30 being secured to the lower end of each shaft 28. The upper end of each of the shafts 28 is equipped with a sheave or pulley 32.

As shown in FIG. 2, each unit is provided with an electrically energizable motor 34, the shaft of each motor provided with a sheave or pulley 36. A drive is established for each spinner 30 by a belt 38 connecting the sheaves 32 and 36. Each frame member is fashioned with an opening 40 through which a stream 18 of glass flows into a spinner or rotor 30.

The peripheral wall of the spinner or rotor 30 is fashioned with a large number of small orifices or passages (not shown) there being ten thousand or more orifices through which the heat-softened glass in the interior of the spinner is projected outwardly by centrifugal forces as small streams, linear bodies or primary filaments.

Each of the members 22 is provided with an annular combustion chamber 48 which is lined with refractory (not shown), each chamber having an annular discharge outlet or throat adjacent and above the peripheral wall of each spinner 30. A fuel and air mixture is admitted into the chamber 48 and combustion occurs therein. The products of combustion in the chamber are extruded through an annular throat or opening as a high temperature gas stream providing a heated environment at the peripheral wall of the rotor for the centrifuged glass streams or primary filaments.

Surrounding the spinner is an annular blower construction 52 which has an annular outlet or delivery orifice adjacent to and spaced from the peripheral wall of the spinner 30. Steam, compressed air or other gas under pressure is admitted to the blower 52 and the blast from the blower engages the bodies, primary filaments or streams of amorphous glass centrifuged from the openings in the wall of the spinner 30 and attenuates the amorphous glass into fibers 54.

It is desirable in fashioning certain end products from the fibers 54 to deliver a bonding resin onto the fibers as they move downwardly from the attenuating units 20. Supported by each of the guard members 24 and arranged in spaced circumferential relation are applicator nozzles 58 for delivering bonding resin, binder or adhesive onto the fibers 54.

In the embodiment illustrated in FIG. 1, the amorphous glass fibers are delivered into a rectangularly-shaped chamber or forming hood 60 defined by a walled enclosure 62. The enclosure 62 is open at the bottom and arranged at the base of the chamber 60 is the upper flight 66 of a movable fiber collector, receiver or foraminous conveyor 67. The collector or conveyor 67 is supported and guided by pairs of rolls 69, one of the rolls being driven by conventional motive means (not shown) to advance the upper flight 66 in a right-hand direction.

Positioned beneath the upper flight 66 in registration with the forming chamber 60 is a suction chamber 71 defined by a thin-walled receptacle 72, the suction chamber 71 being connected by a pipe 74 with a suction blower of conventional construction (not shown) for establishing subatmospheric or reduced pressure in the chamber 71. The reduced pressure or suction existent in the chamber 71 assists in the collection of the amorphous glass fibers upon the collector or conveyor flight 66 and the spent gases of the attenuating blasts from the blowers 52 are conveyed away through the pipe 74. The chamber 60 constitutes a fiber-receiving station.

The arrangement illustrated in FIG. 1 is inclusive of means for delivering crystallizable mineral fibers into the chamber 60 whereby the crystallizable mineral fibers are combined, mixed or commingled with the amorphous glass fibers moving through the chamber. As shown schematically in FIG. 1, there are three mineral fiber delivery means or units 78, the units being adapted to direct the crystallizable mineral fibers into combining or commingling relation with the amorphous glass fibers.

Each of the units 78 is inclusive of a housing 80 which is provided with fiber delivery or discharge means or nozzle 82. Disposed within the housing 80 is a picker device 83 which comprises rotatably mounted pickers or picker wheels 84 having peripheral teeth arranged to engage and fluff up the nodules of crystallizable mineral fibers fed to the wheels. The picker device is conventional and is driven by a motor (not shown).

The function of the picker wheels 84 is to break up the nodules of crystallizable mineral fibers to effect a degree of separation of the fibers to attain better distribution of the crystallizable mineral fibers with the amorphous glass fibers. The crystallizable mineral fibers are indicated at 86. Each housing 80 is equipped with a guide means 88 to receive a body 90 of crystallizable mineral fibers from a supply (not shown).

Figure 3:
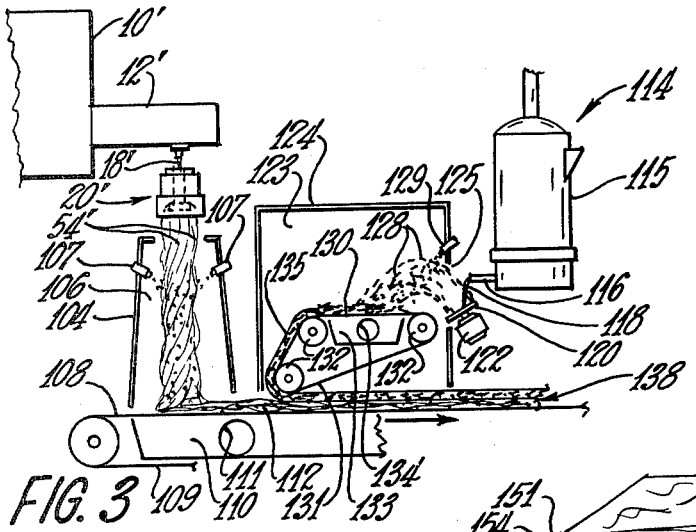
FIG. 3 illustrates an arrangement for forming and orienting amorphous glass fibers with crystallizable mineral fibers to form a mass or body comprising layers of the fibers.

One method of forming crystallizable mineral fibers is schematically illustrated in FIG. 3 and hereinafter described. The crystallizable mineral fibers may be delivered from a fiber-forming means directly to the picker devices 83. Any of the well known conventional methods of forming crystallizable mineral fibers may be used.

Air tubes 92 are formed on the housings 80 and are adapted to be connected with a source of compressed air or other gas under pressure for delivering or projecting the crystallizable mineral fibers from the nozzles 82 to promote better distribution or commingling of the crystallizable mineral fibers with the amorphous glass fibers moving through the chamber 60.

The amorphous glass fibers 54 are usually several inches in length while the crystallizable mineral fibers are of short lengths usually less than one inch with a substantial percentage less than one-fourth inch which enhances a more homogeneous mixing of the short length mineral fibers with the longer amorphous glass fibers. In the arrangement illustrated in FIG. 1, the blended, mixed or commingled amorphous glass fibers 54 and the crystallized mineral fibers 86 are collected as a mass 87 on the collector or conveyor flight 66.

Organic thermosetting bonding resins are delivered onto both the amorphous glass fibers and the crystallizable mineral fibers. Bonding resins that may be used include phenol formaldehyde resin or copolymer of phenol formaldehyde resin and urea, melamine or dicyandiamide resins. Typical resin compositions that may be used are disclosed in U.S. Pat. to Stalego No. 3,223,668 and in U.S. Pat. to Smucker et al 3,380,877. The resin is usually applied in an "A" stage ie. in a water soluble/dispersible solution depending upon the end use of the product. In the arrangement shown in FIG. 1, the bonding resin is delivered onto the amorphous glass fibers by applicators 58. A bonding resin of the same or compatible character is delivered onto the crystallizable mineral fibers in advance of their delivery to the picker devices or units 78.

The commingled resin-bearing fibers are thereafter processed in a manner depending upon the end use for the product. The ratio of the two types of fibers in the fiber blend or mass may vary between about ten percent crystallizable mineral fibers to ninety percent amorphous glass fibers or ten percent glass fibers to ninety percent mineral fibers, a preferred blend range being fifty percent crystallizable mineral fibers and fifty percent amorphous glass fibers to a ratio of seventy-five percent crystallizable mineral fibers and twenty-five percent amorphous glass fibers.

As illustrated in FIG. 1, a sizing roll 94 or other fiber compressing means is disposed at the exit end of the chamber 60 and is adapted to be rotated by a suitable means (not shown). The mass 87 of fibers is compressed into a mat 95 to an extent depending upon the density of the composite fibrous body desired. The range of density of the mat may be varied depending upon the end use for the product.

In the embodiment illustrated, the mat 95 of compressed fibers impregnated with binder is advanced by endless belts 96 and 97 through a curing chamber 98 of an oven 99 in which the binder or resin is set or cured by the application of heat in a well-known conventional manner. The cured mat is particularly useful as insulation as the longer amorphous glass fibers contribute strength and resiliency to the mat, and the shorter crystallizable mineral wool fibers improve thermal properties as they promote a more tortuous path for heat movement through the mat.

These factors significantly improve the fire resistance of the mat particularly since the crystallizable mineral fibers crystallize or devitrify very rapidly when subjected to high temperatures of over 1000° F. Where the crystallizable mineral fibers have a high iron content, the thermal and fire resistance properties of the products made from blends of crystallizable mineral fibers and amorphous glass fibers are further improved.

The fibrous mat 95, upon curing of the binder, may be used as insulation in fire rated acoustical systems, high temperature resistance block, roofing insulation, form board, fire rated cores for walls and doors, fire rated hardboard and other similar uses. While the method illustrated for forming amorphous glass fibers 54 involves blast attenuation of centrifuged glass streams or primary filaments, it is to be understood that other methods may be utilized for forming amorphous glass fibers, as for example the method and arrangement disclosed in Stalego and Leaman U.S. Pat. No. 3,002,224.

The invention includes the processing of amorphous glass fibers and crystallizable mineral fibers to produce a blend or mixture of such fibers of suitable character whereby the fibers may be blown into spaces in building constructions as thermal insulation. In processing the composite fibers to provide a product that may be air blown, the mass of mixed or commingled fibers 87 which comprises a mixture or blend of amorphous glass fibers and crystallizable mineral fibers is delivered in an uncompressed state through the curing chamber 98 to set or cure the binder in the fibers. The mixture of fibers for use as thermal insulation may be of a density of about two pounds per cubic foot.

The mass of fibers is then delivered to a conventional instrumentality known as a beater or granulator (not shown) which fractures or breaks up the longer fibers to shorter length fibers to enhance air blowing of the mixture.

Applicant's invention embraces a method of forming, processing or utilizing bodies or laminations of amorphous glass fibers and bodies or laminations of crystallizable mineral fibers in producing several types of composite fiber end products.

FIG. 3 is illustrative of method and apparatus for concomitantly forming amorphous glass fibers and crystallizable mineral fibers and collecting the respective fibers in contiguous layers. In FIG. 3 the instrumentality or unit 20' for forming amorphous glass fibers corresponds with one of the units 20 shown in FIG. 1. The unit 20' receives a stream 18' of glass from a forehearth 12', the heat-softened amorphous glass flowing into the forehearth from a melting and refining furnace 10'. A single amorphous glass fiber attenuating unit 20' is illustrated in FIG. 3, but it is to be understood that more than one unit may be used in the manner illustrated in FIG. 1.

The attenuated amorphous glass fibers 54' move downwardly from the attenuating instrumentality 20' into an enclosure or forming hood 104 which defines a chamber 106. Mounted by the enclosure 104 are applicators 107 for delivering thermosetting resin or binder onto the fibers 54'. It is to be understood that the applicators may be mounted by the attenuating instrumentality in the manner illustrated in FIG. 1.

The fibers are collected upon an upper flight 108 of a foraminous conveyor or collector 109 as a layer 112, the upper flight 108 of the conveyor moving in a right-hand direction. Disposed below the upper flight 108 of the conveyor 109 is a suction chamber 110, the chamber being connected by a pipe 111 with a suction blower (not shown) for establishing subatmospheric or reduced pressure in the chamber 110, this arrangement assisting in the collection of the fibers upon the conveyor flight 108.

Disposed adjacent the fiber attenuating unit 20' is a facility or apparatus 114 for forming crystallizable mineral fibers. In the embodiment illustrated in FIG. 3, the mineral fiber-forming facility 114 is inclusive of a conventional cupola 115 which is adapted to successively receive charges of crystallizable fiber-forming mineral material and coke. The coke is burned within the cupola and reduces the mineral material to a flowable or molten state, the molten material collecting in the lower part of the cupola.

Connected with the cupola near the bottom is a spout 116 providing a port for the discharge of a stream 118 of the molten mineral material. The stream 118 of mineral material is delivered to a conventional attenuating instrumentality for fiberizing the mineral material. In the schematic illustration of FIG. 3, the stream 118 is engaged with a rotating wheel 120 driven by a motor 122. The engagement of the stream of mineral material with the rotating wheel 120 shatters or breaks up the stream to form fibers of the mineral material.

In the process of fiberizing fusible rock or slag, it is well known that a substantial portion of the mineral material is unfiberized and is in the form of fine particles or "shot". While a rotating fiberizing wheel 120 is illustrated in FIG. 3, it is to be understood that other conventional methods may be used for fiberizing the molten mineral material such as a plurality of rotating wheels. Another conventional method utilizes a high velocity blast of steam to shatter or break up the stream of molten material in fiberizing the mineral material.

The arrangement shown in FIG. 3 is inclusive of a forming chamber 123 defined by a walled forming hood 124, the walled hood having an entrance opening 125 through which the crystallizable mineral fibers 128 and some of the unfiberized material or "shot" are delivered into the chamber 123. An applicator 129 is mounted by the forming hood 124 for delivering thermosetting resin or binder onto the fibers 128, the binder or resin being of the same character as the binder delivered from the applicators 107 onto the amorphous glass fibers in the chamber 106.

The fibers 128 and the unfiberized material are delivered onto the upper flight 130 of a foraminous conveyor 131 which is mounted on rolls 132, one of which is a driven roll for moving the upper flight 130 of the conveyor in a left-hand direction. Disposed beneath the upper flight 130 of the conveyor 131 is a suction chamber 133, the chamber being connected by a pipe 134 with a suction blower (not shown) for establishing subatmospheric or reduced pressure in the chamber 133.

The suction or reduced pressure in the chamber 133 assists in collecting the crystallizable mineral fibers 128 on the conveyor flight 130 to form a layer or mass 135 of crystallizable mineral fibers on the conveyor flight 130. The suction or reduced pressure in the chamber 133 also assists in removing unfiberized particles or "shot" from the mineral fibers on the flight 130 of the conveyor and thereby effectively reduces the amount of unfiberized material in the layer 135 of crystallizable mineral fibers, the unfiberized material being conveyed away through the pipe 134 as waste.

As illustrated in FIG. 3, the layer or mass 135 of crystallizable mineral fibers is delivered by the conveyor 131 into contiguous relation with the layer 112 of amorphous glass fibers on the collector or conveyor flight 108. The composite fibrous body 138 may be further processed to form various end products. For example, the fibrous body or assemblage 138 may be compressed to a high density and the resin in the fibers fully cured to form a substantially rigid hard board.

If it is desired to concomitantly form a fibrous body or assemblage of multilayers of fibers, additional fiber-forming units 20 and mineral fiber attenuating facilities 114 may be positioned alternately along the conveyor flight 108 whereby the collected amorphous glass fibers and crystallizable mineral fibers are arranged in contiguous alternate layers or laminations.

Figure 4:
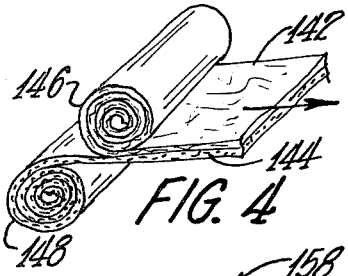
FIG. 4 is a schematic isometric view illustrating the orientation of preformed resin-bearing laminations of amorphous glass fibers and crystallizable mineral fibers into a laminated body.

It is to be understood that layers of resin-bearing amorphous glass fibers and layers of resin-bearing crystallizable mineral fibers may be formed separately and brought into contiguous relation to form laminated products of the two types of fibers. FIG. 4 is illustrative of assembling a layer 142 of preformed amorphous glass fibers with a layer 144 of preformed crystallizable mineral fibers.

The layer 142 of amorphous glass fibers may be formed into a roll 146 as the layer of fibers is delivered from a fiber attenuating unit such as a unit 20. The layer 144 of crystallizable mineral fibers may be formed into a roll 148, the layer of crystallizable mineral fibers being taken directly from a fiber-forming facility of the character shown in FIG. 3.

The resin-bearing layers or laminations 142 and 144 may be brought into contiguous engaging relation as shown in FIG. 4, the assemblage being conveyed through suitable sizing or compressing rolls and the assemblage delivered through a curing oven to set or cure the binder in the fibrous layers. The assemblage of the layers of fibers may be compressed to a density desired depending upon the particular end product. The layers of fibers are adhesively joined by the resin or binder.

Where the end product is acoustical tile, wall paneling, pipe insulation or the like, the assemblage of layers may be compressed to a density in a range of from one pound to about sixteen pounds or more per cubic foot.

Figure 5:
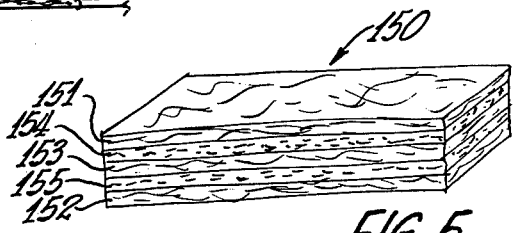
FIG. 5 is a fragmentary isometric view illustrating a laminated body of resin-bearing crystallizable mineral fibers and amorphous glass fibers.

FIG. 5 is illustrative of a laminated fibrous body or assemblage 150 comprising alternate layers of amorphous glass fibers and crystallizable mineral fibers. In FIG. 5, the outer layers 151, 152, and the central layer 153 are of resin-bearing amorphous glass fibers and the intermediate alternate layers 154, 155 are of resin-bearing crystallizable mineral fibers. The assemblage 150 comprising the fibrous layers may be compressed by sizing rolls or other means and the compressed laminated body or assemblage subjected to heat in an oven to set or cure the binder in the fibers of the layers.

The assemblage 150 compressed to a comparatively high density is usable as fire-rated hardboard, roof insulation or the like. Hardboard or roof insulation of this character has high strength characteristics and, if subjected to high heat or flames, the amorphous glass fibers may be melted, but the crystallizable mineral fibers will crystallize at temperatures above 1000° F. thus providing a body or board which resists collapse by reason of the crystallization or devitrification of the mineral fibers. The outer layers 151 and 152 of amorphous glass fibers provide a smooth surface finish for the product. The density for hardboard is generally in a range of from twenty-five pounds to sixty pounds per cubic foot.

Figure 6:
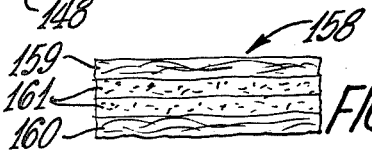
FIG. 6 is a side elevational view illustrating another form of orientation of laminations of resin-bearing amorphous glass fibers and crystallizable mineral fibers.

FIG. 6 illustrates a modified assemblage or body 158 of layers of fibers. The outer layers 159 and 160 are resin-bearing amorphous glass fibers and the inner layers 161 are resin-bearing crystallizable mineral fibers.

Figure 7:
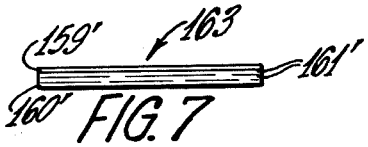
FIG. 7 is an elevational view of the orientation of amorphous glass fibers and crystallizable mineral fibers of FIG. 6, the fibers compressed into a dense body and binder therein cured.

FIG. 7 illustrates the end product formed from the assemblage 158, shown in FIG. 6, by compressing the assemblage to a high density and the resin cured in the assemblage to form a substantially rigid product 163 such as a hardboard or panel comprising compressed outer layers 159' and 160' of amorphous glass fibers.

The outer layers 159' and 160' being of amorphous glass fibers provide a smooth surface finish for the panel or hardboard 163. The product 163 has high fire rating by reason of the central core being of crystallizable mineral fibers which renders the panel resistant to collapse should the product be subjected to high heat or flames.

Figure 8:
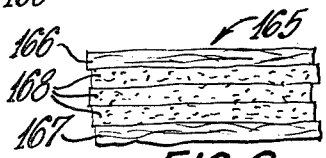
FIG. 8 is an elevational view illustrating another form of orientation of uncompressed layers of amorphous glass fibers and crystallizable mineral fibers.

FIG. 8 illustrates an assemblage or fibrous body 165 which includes outer layers 166 and 167 of resin-bearing amorphous glass fibers and a central core comprising layers 168 of resin-bearing crystallizable mineral fibers.

Figure 9:
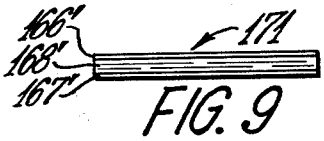
FIG. 9 illustrates a product fashioned by compressing the layers of fibers shown in FIG. 8 and the binder therein cured in the compressed body.

FIG. 9 illustrates the end product formed from the assemblage 165, shown in FIG. 8, by compressing the assemblage to a high density and the resin cured in the assemblage to form a substantially rigid hardboard, panel or like product 171 comprising compressed outer layers 166' and 167' of the amorphous glass fibers and the core layers 168' of compressed crystallizable mineral fibers. The panel or hardboard 171 has high strength characteristics and with a comparatively thick core of crystallizable mineral fibers is highly resistant to collapse at high temperatures. The products 163 and 171 of FIGS. 7 and 9 may be used as acoustical tile and ceiling board or the like.

Figure 10:
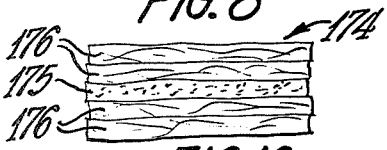
FIG. 10 is a side elevational view illustrating another orientation of uncompressed layers of amorphous glass fibers and crystallizable mineral fibers.

FIG. 10 illustrates an assemblage or body 174 of layers of resin-bearing amorphous glass fibers and a layer of resin-bearing crystallizable mineral fibers. The central layer 175 is fashioned of crystallizable mineral fibers and layers 176 of resin-bearing amorphous glass fibers are arranged at each side of the central core 175 of crystallizable mineral fibers.

Figure 11:
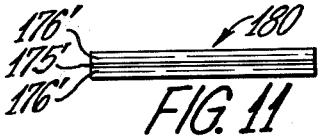
FIG. 11 illustrates a product fashioned from the orientation of layers of fibers shown in FIG. 10 after the layers of fibers are compressed and the binder therein cured.

FIG. 11 illustrates the end product formed from the assemblage shown in FIG. 10 by compressing the assemblage to a high density and the resin cured in the assemblage to form a substantially rigid hardboard, panel 180 or the like comprising compressed outer layers 176' of the amorphous glass fibers and a central core 175' of compressed crystallizable mineral fibers. The panel or hardboard 180 has high strength characteristics by reason of the several layers or laminations of amorphous glass fibers.

Figure 12:
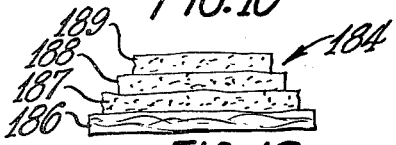
FIG. 12 is an end view illustrating an orientation of layers of uncompressed amorphous glass fibers and crystallizable mineral fibers preparatory to forming tubular bodies or pipe insulation.
Figure 13:
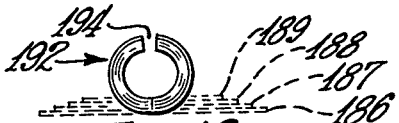
FIG. 13 illustrates a tubular formation formed by compressing the layers of fibers and molding the body of fibers shown in FIG. 12.

FIG. 12 illustrates an end view of an assemblage or body 184 of one or more layers of resin-bearing amorphous glass fibers and layers of resin-bearing crystallizable mineral fibers, the layers being dimensioned in width to fashion the assemblage 184 into a tubular fibrous body 192 illustrated in FIG. 13 for use as pipe insulation. The outer layer or lamination 186 of the assemblage 184 is of the greatest width and is of resin-bearing amorphous glass fibers. The layers or laminations 187, 188 and 189 are fashioned of resin-bearing crystallizable mineral fibers, the layers 187 through 189 being preferably progressively reduced in width to facilitate molding the assemblage into tubular configuration.

The assemblage 184 of layers of fibers is processed in a conventional molding apparatus and the fibers of the layers compressed to an increased density when the molds are closed. The molds in closed position are subjected to heat to set or cure the thermosetting bonding resin in the fibers, the molding of the fibers resulting in a tubular configuration or tube 192 of the character shown in FIG. 13. An example of one method and apparatus for molding fibrous pipe insulation is disclosed in U.S. patent to Tkacs 3,088,573.

The tubular fibrous body 192, shown in FIG. 13, may be split as at 194 and the split extended in the lower wall about two-thirds of the wall thickness, as shown in FIG. 13, providing a hinge region to facilitate assembly or installation of the tubular insulating body 192 on pipe. The fibers are compressed by the mold to a density so that the finished tubular insulation is substantially rigid. The outer layer 186 of the longer amorphous glass fibers imparts high strength characteristics to the molded body 192 and the inner layers 187 through 189 of crystallizable mineral fibers provide high thermal insulating properties and are resistant to collapse under high temperatures as the mineral fibers crystallize or devitrify to form a solid body.

The commingled or blended mixture of amorphous glass fibers and crystallizable mineral fibers may be formed into fibrous products through the use of a so-called "wet" process. In carrying out the "wet" process the amorphous glass fibers and the crystallizable mineral fibers together with additives such as clay and starch are mixed together with water to form a slurry. The slurry is delivered onto wire conveyor belts such as those used in the well-known Fourdrinier paper making machine.

Dewatering of the slurry on the wire belts is accomplished by gravity and by suction or reduced pressure beneath the belts. The "wet lap" or web is passed through roller presses for further dewatering and is conveyed through a drying facility. The web is then cut into the sizes desired for the particular end product. The end products have high strength characteristics by reason of the presence of the amorphous glass fibers and high fire resistant characteristics provided by the short length crystallizable mineral fibers. The products made by the "wet" process are generally in a range of density of about twenty-pounds to thirty pounds per cubic foot.

It is apparent that, within the scope of the invention, modifications and different arrangements may be made other than as herein disclosed, and the present disclosure is illustrative merely, the invention comprehending all variations thereof.

I claim:

1. A fibrous product comprising a body of crystallizable mineral fibers and a body of amorphous glass fibers adhered by a resinous binder to the body of mineral fibers.

2. A fibrous product comprising a laminate of resin-bearing crystallizable mineral fibers and at least one laminate of resin-bearing amorphous glass fibers adhered to the laminate of mineral fibers.

3. A fibrous product comprising a body of crystallizable mineral fibers and a body of amorphous glass fibers in contiguous engagement with the body of mineral fibers, and a resin bonding the bodies together.

4. A fibrous body comprising a layer of resin-bonded crystallizable mineral fibers, a layer of resin-bonded amorphous glass fibers adhered to the layer of mineral fibers, the densities of the respective layers of fibers being in a range of one pound per cubic foot to sixteen pounds per cubic foot.

5. A fibrous product comprising a body of resin-bonded crystallizable mineral fibers and a layer of resin-bonded amorphous glass fibers adhered by resin to a surface of the body of crystallizable mineral fibers.

6. A fibrous product comprising a body of resin-bonded crystallizable mineral fibers, and a body of resin-bonded amorphous glass fibers adhered to each side surface of the body of crystallizable mineral fibers.

7. A tubular fibrous product comprising an inner layer of resin-bearing crystallizable mineral fibers and an outer layer of resin-bearing amorphous glass fibers contiguous with the inner layer of mineral fibers, the layers of fibers being adhered together upon curing of the resin.

8. A fibrous panel comprising a substantially rigid body of resin-bonded crystallizable mineral fibers and a surfacing layer adhered by resin to the body comprising resin-bonded amorphous glass fibers.

9. The method of forming a composite fibrous mass including directing attenuated fibers of amorphous glass toward a conveyor, directing crystallizable mineral fibers toward the conveyor, collecting one type of fibers on the conveyor, and depositing the other type of fibers on the collected fibers on the conveyor.

10. The method of producing a fibrous product including forming a lamination of resin-bonded amorphous glass fibers, forming a lamination of resin-bonded crystallizable mineral fibers, and adhesively joining the laminations of fibers by resin.

11. The method of forming a composite fibrous body including attenuating streams of amorphous glass to fibers, delivering thermosettable resin onto the glass fibers, attenuating molten crystallizable mineral material to fibers, delivering thermosettable resin onto the mineral fibers, collecting the glass fibers and the mineral fibers on a collector to form a fibrous body having a layer of amorphous glass fibers and a contiguous layer of crystallizable mineral fibers, and curing the resin in the fibers whereby the layers of fibers are adhered together.

12. A composite fibrous product comprising a core of resin-bearing crystallizable mineral fibers, a facing layer of resin-bearing amorphous glass fibers, said facing layer being adhered by the resin to a surface of the core of crystallizable mineral fibers.

* * * * *